US008424668B2

(12) United States Patent
Gonzalez Alemany et al.

(10) Patent No.: US 8,424,668 B2
(45) Date of Patent: Apr. 23, 2013

(54) MOVING RAMP FOR THE TRANSPORTATION OF PEOPLE AND/OR GOODS

(75) Inventors: Miguel Angel Gonzalez Alemany, Oviedo (ES); Mónica Diaz Sorribas, Gijon (ES); José Ojeda Arenas, Gijon (ES)

(73) Assignees: Thyssenkrupp Elevator Innovation Center, S.A., Gijon, Asturias (ES); Thyssenkrupp Elevator (ES/PBB) GmbH, Essen (DE)

( * ) Notice: Subject to any disclaimer, the term of this patent is extended or adjusted under 35 U.S.C. 154(b) by 151 days.

(21) Appl. No.: 12/829,833

(22) Filed: Jul. 2, 2010

(65) Prior Publication Data

US 2011/0000762 A1 Jan. 6, 2011

(30) Foreign Application Priority Data

Jul. 3, 2009 (ES) ..... 200930415

(51) Int. Cl.
*B66B 21/02* (2006.01)

(52) U.S. Cl.
USPC ..... 198/325; 198/324

(58) Field of Classification Search ..... 198/323–327, 198/333
See application file for complete search history.

(56) References Cited

U.S. PATENT DOCUMENTS

| | | | | |
|---|---|---|---|---|
| 5,398,800 | A | 3/1995 | Hofling et al. | |
| 5,971,129 | A * | 10/1999 | Stawniak et al. | 198/325 |
| 6,068,107 | A * | 5/2000 | Brun-Jarret | 198/600 |
| 6,142,286 | A * | 11/2000 | Ulrich et al. | 198/325 |
| 6,241,070 | B1 * | 6/2001 | Loder | 198/323 |
| 6,382,388 | B1 * | 5/2002 | Hirai et al. | 198/332 |
| 6,490,979 | B1 * | 12/2002 | Pfleger et al. | 104/172.3 |
| 6,644,457 | B2 * | 11/2003 | Lauch | 198/322 |
| 7,063,202 | B2 * | 6/2006 | Ossendorf | 198/321 |
| 7,334,672 | B2 * | 2/2008 | Sheehan et al. | 198/323 |
| 7,353,931 | B2 * | 4/2008 | Jarvis et al. | 198/325 |
| 7,367,441 | B2 * | 5/2008 | Mustalahti et al. | 198/325 |

FOREIGN PATENT DOCUMENTS

| | | |
|---|---|---|
| DE | 64 662 | 3/1892 |
| DE | 177 875 | 9/1905 |
| WO | WO 03/051754 | 6/2003 |

OTHER PUBLICATIONS

European Search Report from EP Application No. 10 38 2185 mailed Oct. 15, 2010.

* cited by examiner

*Primary Examiner* — Douglas Hess
(74) *Attorney, Agent, or Firm* — Merchant & Gould P.C.

(57) ABSTRACT

Moving ramp for the transportation of people and/or goods, comprising a moving belt (1) limited between upper and lower fixed plates (3) for loading and unloading. The moving belt is constituted by a plurality of inclined pallets (4-4'), which are parallel to the noticeably horizontal lower fixed plates (3), having said pallets the inclination of the moving belt (1).

4 Claims, 4 Drawing Sheets

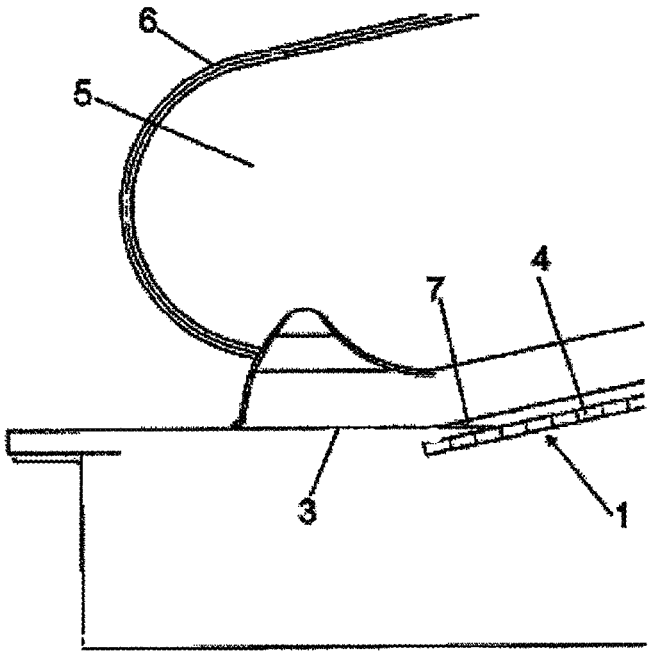
FIG. 6
FIG. 7
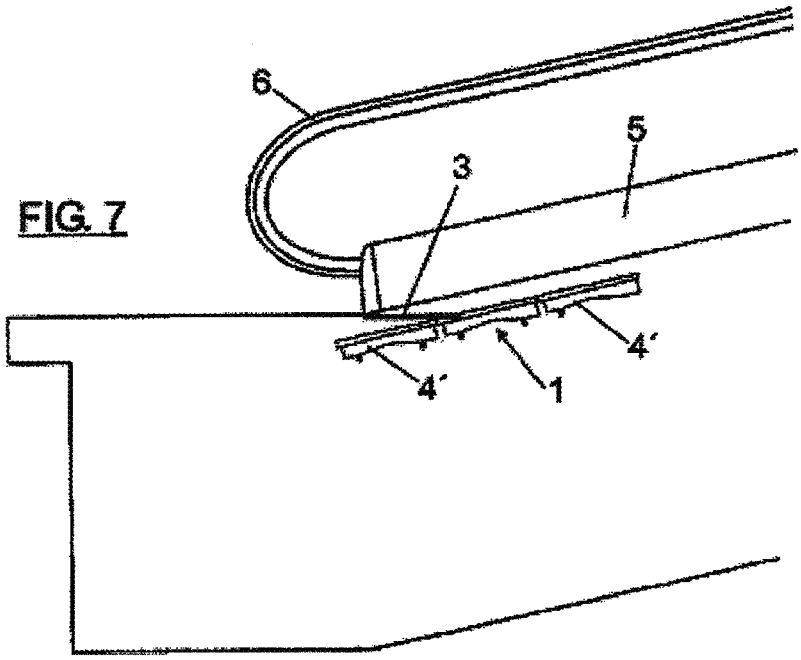

MOVING RAMP FOR THE TRANSPORTATION OF PEOPLE AND/OR GOODS

This application claims benefit of Serial No. 200930415, filed 3 Jul. 2009 in Spain and which application is incorporated herein by reference. To the extent appropriate, a claim of priority is made to the above disclosed application.

FIELD OF THE INVENTION

The present invention refers to a moving ramp for the transportation of people and/or goods, comprising a moving belt and upper and lower fixed plates for loading and unloading. The moving belt is constituted by a plurality of pallets which slide between side guides and balustrades with handrails.

BACKGROUND OF THE INVENTION

Moving walkways are born as an evolution of escalators, so that it is possible to use wheeled devices, such as shopping carts, trolleys, pushchairs or vehicles for handicapped people, whose transport cannot be carried out in an escalator. This type of moving walkways, usually known as "moving ramps", have in the lower head a transition between the passable moving surface and the lower fixed area, which consist of grooved combs of the fixed plates which are intertwined with grooves of the pallets which form the passable moving surface, facilitating the entrance and exit of the user and thus preventing in this way his/her trapping.

Conventional passenger conveyor systems, such as escalators or moving walkways, in their traditional conception, place the combs in parallel with the passable moving surface which leads to two classic solutions for the lower head of the ramps.

The first one consists of placing both the lower combs, fixed part, and the loading moving surface horizontally. This implies the need of a curved transition of this loading moving surface or belt of pallets from their horizontal part to the inclined one, which turns out into a greater total length of the moving walkway. This leads to a smaller harnessing of the place of installation.

In the second solution, both the lower combs and the pallets are placed in an inclined arrangement. In this way, the lower head is not lengthened as in the previous solution, but there are problems in the transportation of people with trolleys both at the entrance through the lower head, upwardly, and at the exit, downwardly. In this way, in upward direction, the user must exert a force to overcome the weight of the trolley which hinders his/her entrance. In downward direction, the transition of the trolleys from the moving belt to the inclined fixed plates causes the release of the trolley brake systems; so the user has to hold the trolley to prevent it from leaving the moving walkway uncontrollably.

DESCRIPTION OF THE INVENTION

The present invention refers to a passenger and/or goods conveyor system constituted by a main moving belt and upper and lower fixed plates for loading and unloading. The moving belt circulates through an appropriate guiding system and is activated by an appropriate power transmission system, being limited sideways by two balustrades on which there circulate handrails at the same speed as the moving belt; and with the appropriate control and safety systems for the correct operation of the system.

The moving ramp object of the present invention is characterized in that the lower fixed plates and the pallets of the moving belt are not parallel, being the lower fixed plates noticeably horizontal, while the pallets of the moving belt are displaced in inclined position, from said fixed plates, with the inclination of the moving belt, improving the entrance and exit of carts, wheelchairs, pushchairs and other similar devices.

In a preferred configuration, the moving belt is constituted by short pallets, less than 200 mm long, made of aluminum, magnesium, steel or other metals or combinations of metals, which enable to make a turning of small dimensions in the lower part; thus reducing the space needs for the installation of the moving walkway. The turning of the pallets is produced according to an anti-polygonization curve, appropriate for a pit dimension smaller than 800 mm. It is also possible to build the plates with other non-metallic materials, such as plastics, rubber or other materials with characteristics appropriate for the required use.

There are also possible configurations in which the moving belt is constituted by plates of greater dimensions. Said plates can turn or return parallel to the passable pathway. There are even possible configurations in which the moving belt is a continuous belt made of appropriate flexible materials.

In the preferred configuration, the moving belt has a passable grooved surface; and the lower fixed plate has on its closest edge to the moving belt combs made of aluminum, magnesium or any other material or combinations of metallic or non-metallic materials, the spikes of which are inserted in the grooves of the moving belt; thus attaining a secure transition. There are also possible configurations in which the moving belt is smooth, and the end of the fixed plates close to the moving belt is constituted by a scraper, which guarantees the exit of the users and/or goods.

The passable surface of the moving belt and the adjacent edge of the lower fixed plates are complementary, being possible to move the edge of these fixed plates to attain this complementarity. To that end, at least the part of the lower fixed plates adjacent to the moving belt will have partial tilting capacity, around a horizontal axis perpendicular to the sliding direction of the moving belt, to secure the support of the free edge thereof on the pallet surface.

According to an embodiment, the system of combs articulates in a point under the passable part of the moving belt. With this arrangement it is attained that any element trapped between the combs and the moving belt, moves the comb plate in an appropriate direction to be able to activate a safety system which stops the moving belt. Of course, other configurations with sliding and/or articulated systems are possible, which allow the movement of the plates in the appropriate direction in case an object is trapped between the fixed plates and the moving belt. For example, the part or set of parts which contain the end of the lower fixed plate closest to the moving belt can slide in some sliding devices to allow the activation of a safety device. Also, the part or set of parts which contain the end of the lower fixed plate closest to the moving belt can move through a set of articulated bars and/or sliding devices to allow the activation of a safety device.

With the constitution described, the moving ramp of the invention has the following advantages:

- It allows a safer use for users with carts, wheelchairs, pushchairs and similar devices in moving walkways whose moving belt circulates downwardly.
- It allows a more comfortable use for users with carts, wheelchairs, pushchairs and similar devices in moving walkways whose moving belt circulates upwardly.

It reduces space needs for the installation of the aforementioned inclined walkways.

BRIEF DESCRIPTION OF THE DRAWINGS

In the attached drawings an example of a non-limiting embodiment is described, where:

FIG. 6 corresponds to detail C of FIG. 5, at greater scale, with the moving belt constituted by short plates.

FIG. 7 is a similar view to that of FIG. 6, in which the moving belt is constituted by long plates.

DETAILED DESCRIPTION OF AN EMBODIMENT

The characteristics and advantages of the moving ramp of the invention will be understood better with the following description of a non-limiting example of an embodiment, shown in the aforementioned drawings.

Figure 1:
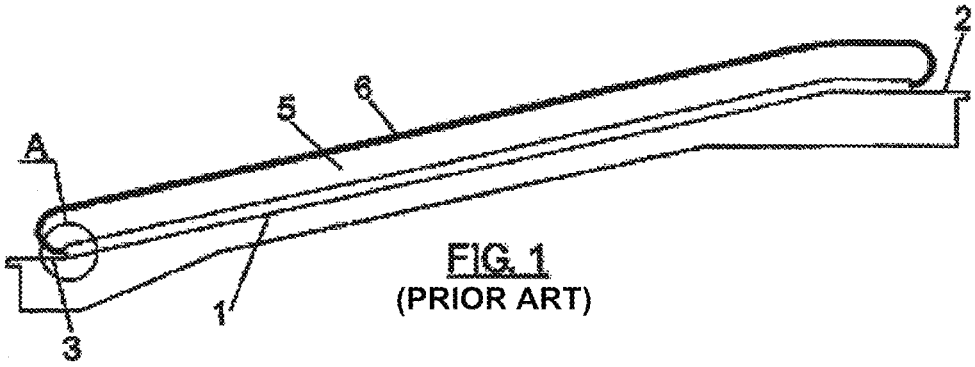
FIG. 1 (PRIOR ART)
FIG. 1 shows a longitudinal sectional view, of the central plane of the inclined walkway, of traditional constitution, in which both the lower combs and the pallets of the moving belt occupy inclined parallel positions.
Figure 2:
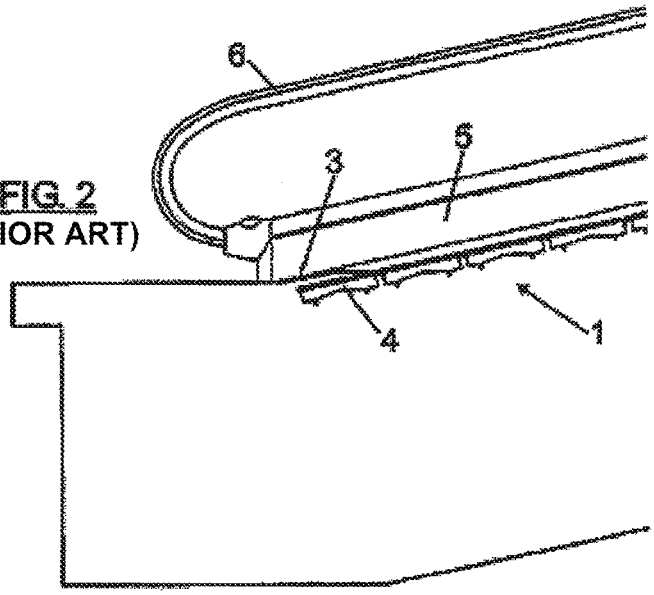
FIG. 2 (PRIOR ART)
FIG. 2 corresponds to detail A of FIG. 1, at greater scale.

FIGS. 1 and 2 show a moving ramp of traditional constitution, comprising a moving belt 1 and upper 2 and lower fixed plates 3. The moving belt comprises pallets 4 which slide on guides and between balustrades 5 with handrails 6. In the ramp shown in FIGS. 1 and 2 the fixed plates 3 and the pallets 4 of the moving belt are parallel and arranged in inclined position.

Figure 3:
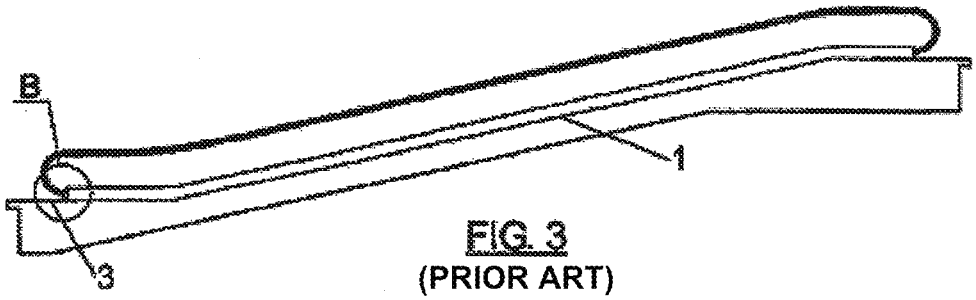
FIG. 3 (PRIOR ART)
FIG. 3 shows a longitudinal sectional view, of the central plane of the inclined walkway, of traditional constitution, in which the lower combs and the moving belt, in the loading area, occupy horizontal positions.
Figure 4:
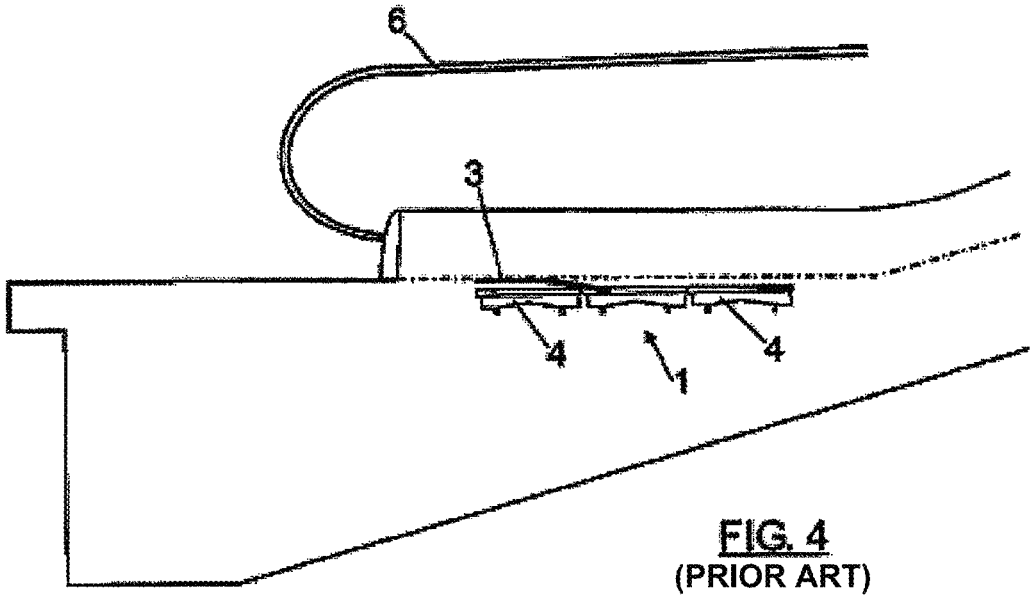
FIG. 4 (PRIOR ART)
FIG. 4 corresponds to detail B of FIG. 2, at greater scale.
Figure 5:
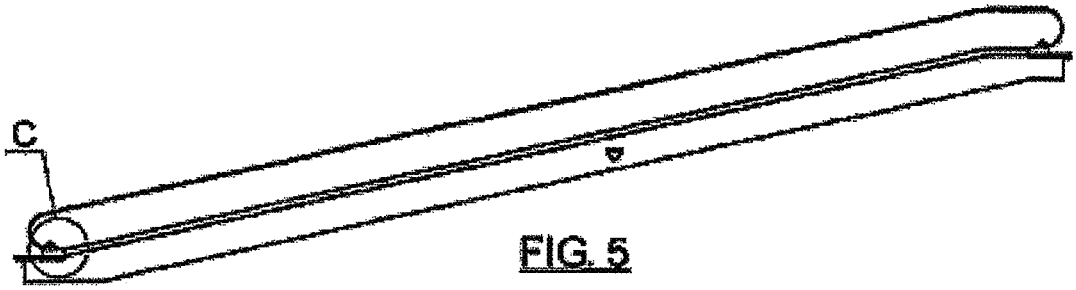
FIG. 5 is a longitudinal sectional view, of the central plane of a walkway with the configuration of the present invention.

FIGS. 3 and 4 show another traditional embodiment of a moving ramp for the transportation of people and goods, with a general constitution similar to the one described with reference to FIGS. 1 and 2, but in which the lower fixed plates 3 and the pallets 4 of the moving belt 1, also parallel, are arranged in horizontal position.

The aforementioned embodiments have the problems described above.

FIGS. 5 to 9 show a moving ramp for the transportation of people and/or goods with the constitution of the present invention.

According to the invention, the lower fixed plates 3 and the pallets 4 of the moving belt 1 are not parallel. The lower fixed plates 3 are horizontal or have a small upward inclination, while the pallets 4 of the moving belt 1 run in inclined position, at least from the upward edge of the fixed plates 3, as it can be clearly seen in FIGS. 6, 7 and 9.

Figure 8:
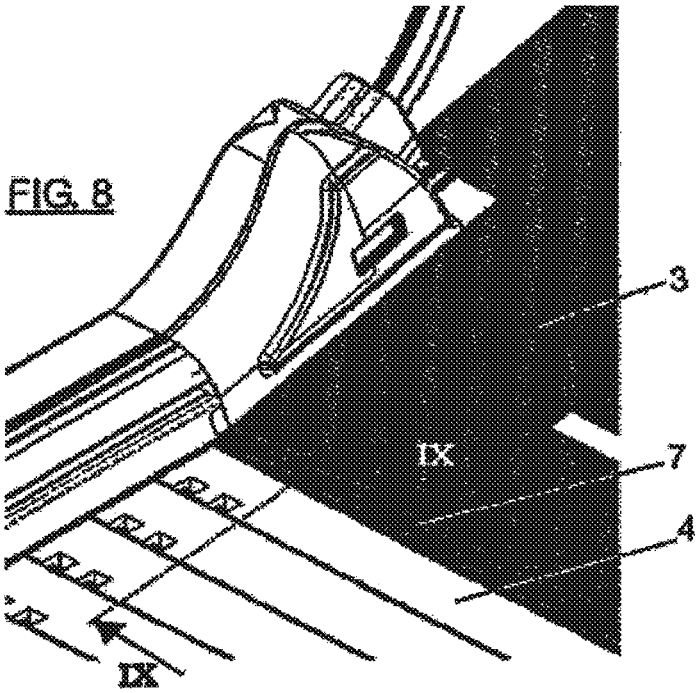
FIG. 8 shows a perspective view of the coupling between pallets of the moving belt and combs of the lower fixed plates.
Figure 9:
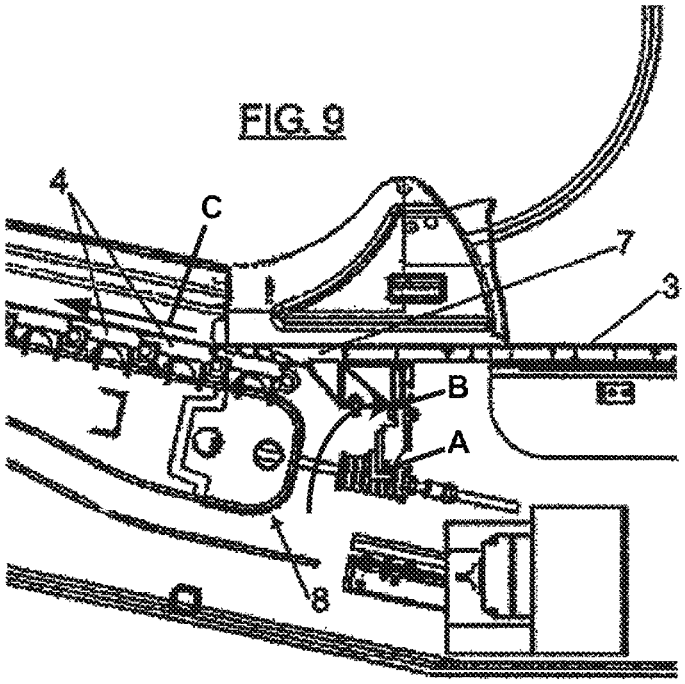
FIG. 9 shows a longitudinal sectional partial view of the lower head of the walkway of the invention, taken according to the cutting line IX-IX of FIG. 8.

The pallets 4 are grooved in parallel direction to the displacement of the moving belt 1 and the lower fixed plates 3 will end in a comb 7, FIGS. 8 and 9, adjacent to the moving belt 1, inserting the spikes of said tooth in the valleys or recesses of the pallet 4 grooving. As shown in FIG. 9, in one embodiment, the system of combs 7 articulates in a point (A) under the passable part of the moving belt.

In the lower fixed plates 3 at least the combs 7 will run in horizontal position while the pallets 4 will have the inclination of the moving walkway. In this way, the problems of entrance and exit of carts for conventional walkways described above are eliminated or minimized.

According to the invention, both the combs 7 and the handrail 6 entrance are placed in horizontal arrangement, without the need that the passable moving surface be parallel thereto, rather it has the inclination required by the ramp. In this way, complying with the fundamental requirements of the transition between the mobile part and the fixed part, it is not required a lengthening of the lower head of the ramp and it facilitates both the user entrance and exit with a cart through the lower head.

In the horizontal entrance, with the walkway operating in an upward direction, it is the passable moving surface of the ramp itself which pulls from the cart, reducing the users effort and facilitating their boarding.

In the horizontal exit, with the walkway operating in downward direction, the rear wheels are blocked until the passable moving surface is abandoned, the cart being in horizontal position so that the user does not have to exert any effort to hold the cart.

In FIG. 6 the moving belt 1 comprises short pallets 4, while in FIG. 7 the moving belt 1 comprises long pallets 4'.

FIG. 8 shows better the coupling between the pallets 4 and the combs 7.

FIGS. 8 and 9 show the constitution of the moving belt 1 with short pallets 4, which enable to perform a turning curve 8 in the lower part of reduced dimensions, thus reducing the space needs for the installation of the walkway. At least the part of the lower fixed plates 3 adjacent to the moving belt will have partial tilting capacity, around a horizontal axis (B) perpendicular to the sliding direction (arrow C) of the moving belt, to secure the support of the free edge thereof on the pallet surface.

The invention claimed is:

1. Moving ramp for the transportation of people and/or goods, comprising a moving belt, including a plurality of pallets which slide between side guides; upper and lower fixed plates for loading and unloading; and balustrades with handrails, sideways limiting the moving belt, wherein the lower fixed plates and the pallets of the moving belt are not parallel, the lower fixed plates being arranged in a horizontal position, and wherein the pallets of the moving belt are displaced in inclined position from said fixed plates with upper edges of the pallets aligning with upper edges of adjacent pallets to form a continuous upper inclined ramp surface parallel with the inclination of the moving belt; and wherein the pallets of the moving belt are less than 200 mm long and the turning of the pallets is produced according to an anti-polygonization curve.

2. The moving ramp according to claim 1, wherein at least the part of the lower fixed plates adjacent to the moving belt partially turns around a horizontal axis perpendicular to the sliding direction of the moving belt, to secure a support of the upper edge on a surface of the pallets.

3. The moving ramp according to claim 2, wherein at least the part of the lower fixed plates adjacent to the moving belt is articulated with respect to a pivot point under the passable surface.

4. The moving ramp according to claim 1, wherein the turning of the pallets is produced according to an anti-polygonization configured for a pit dimension less than 800 mm.

* * * * *